US011273356B2

(12) United States Patent
Hagel et al.

(10) Patent No.: US 11,273,356 B2
(45) Date of Patent: Mar. 15, 2022

(54) HIGH-TENSION SAFETY NET IN A TRAMPOLINE

(71) Applicant: Avero AB, Gothenburg (SE)

(72) Inventors: Thomas Hagel, Uddevalla (SE); Erik Birgersson, Gothenburg (SE); Bas van Den Eijkhof, Olofstorp (SE)

(73) Assignee: Avero AB, Gothenburg (SE)

( * ) Notice: Subject to any disclaimer, the term of this patent is extended or adjusted under 35 U.S.C. 154(b) by 219 days.

(21) Appl. No.: 16/750,427

(22) Filed: Jan. 23, 2020

(65) Prior Publication Data

US 2020/0238152 A1 Jul. 30, 2020

Related U.S. Application Data

(60) Provisional application No. 62/797,214, filed on Jan. 26, 2019, provisional application No. 62/797,216, (Continued)

(51) Int. Cl.
*A63B 71/00* (2006.01)
*A63B 5/11* (2006.01)
(Continued)

(52) U.S. Cl.
CPC ..... *A63B 71/0054* (2013.01); *A63B 5/11* (2013.01); *A63B 21/023* (2013.01);
(Continued)

(58) Field of Classification Search
CPC ..... A63B 71/0054; A63B 5/11; A63B 21/023; A63B 21/0428; A63B 21/4033;
(Continued)

(56) References Cited

U.S. PATENT DOCUMENTS

X504038 8/1893 Judson
X652617 6/1900 Holtz
(Continued)

FOREIGN PATENT DOCUMENTS

AU 2015202862 A1 12/2015
AU 2017200402 A1 2/2017
(Continued)

OTHER PUBLICATIONS

European search report for EP Application No. 20153446.8, entitled "Trampoline with Corner Support Bar," foreign counterpart of U.S. Appl. No. 16/750,391, filed Jan. 23, 2020, also assigned to Avera AB. Search report dated Jun. 5, 2020.
(Continued)

*Primary Examiner* — Garrett K Atkinson
(74) *Attorney, Agent, or Firm* — AWA Sweden AB; Thomas L. Ewing

(57) ABSTRACT

Embodiments of the invention provide a high-tension safety net that may be attached to a trampoline using a plurality of safety poles. The safety poles may be attached to the frame of the trampoline. The safety poles include a plurality of top caps, each top cap adapted to receive and hold a tether attached to the safety net. The safety net may include a high-tension line at its top that attaches to the plurality of tethers. The safe net may be attached to the trampoline following a set of assembly procedures that does not require trampoline assembly workers of average height to use a ladder to attach the safety net.

12 Claims, 8 Drawing Sheets

Related U.S. Application Data filed on Jan. 26, 2019, provisional application No. 62/797,215, filed on Jan. 26, 2019.

(51) Int. Cl.

| | |
|---|---|
| ***A63B 21/04*** | (2006.01) |
| ***A63B 21/00*** | (2006.01) |
| ***A63B 21/02*** | (2006.01) |
| ***A63B 71/02*** | (2006.01) |

(52) U.S. Cl.

CPC ..... *A63B 21/0428* (2013.01); *A63B 21/4033* (2015.10); *A63B 71/023* (2013.01); *A63B 2071/009* (2013.01); *A63B 2071/0063* (2013.01); *A63B 2209/00* (2013.01)

(58) Field of Classification Search

CPC ..... A63B 71/023; A63B 2071/0063; A63B 2071/009; A63B 2209/00; A63B 71/022; A63B 2208/12

See application file for complete search history.

(56) References Cited

U.S. PATENT DOCUMENTS

| | | | | |
|---|---|---|---|---|
| 2,370,990 | A | 3/1945 | Nissen | |
| 3,546,721 | A | 12/1970 | Cleary | |
| 4,433,838 | A | 2/1984 | Gordon | |
| 4,900,011 | A | 2/1990 | Nolet | |
| 5,385,518 | A | 1/1995 | Turner | |
| 5,399,132 | A | 3/1995 | Bailey | |
| D382,618 | S | 8/1997 | Gift | |
| 5,665,040 | A | 9/1997 | Ho | |
| 5,700,232 | A | 12/1997 | Clausen et al. | |
| 5,776,003 | A | 7/1998 | Kenny | |
| 5,816,956 | A * | 10/1998 | Ellis | A63B 61/00 473/490 |
| 5,911,535 | A | 6/1999 | Gvolch | |
| 6,053,845 | A * | 4/2000 | Publicover | A63B 71/023 482/35 |
| 6,129,649 | A | 10/2000 | Yang | |
| 6,206,811 | B1 | 3/2001 | Lat | |
| 6,261,207 | B1 | 7/2001 | Publicover | |
| 6,319,174 | B1 | 11/2001 | Alexander | |
| 6,607,468 | B1 | 8/2003 | Nichols, Jr. | |
| 6,672,997 | B1 | 1/2004 | Winkler | |
| 6,676,576 | B1 | 1/2004 | Wu | |
| 6,866,617 | B2 | 3/2005 | Chen | |
| D536,405 | S | 2/2007 | Freeman | |
| 7,481,740 | B2 | 1/2009 | Colling | |
| 7,678,024 | B2 | 3/2010 | Alexander | |
| 7,708,667 | B2 | 5/2010 | Alexander | |
| 7,758,471 | B2 | 7/2010 | Nelson | |
| 7,850,575 | B1 | 12/2010 | Hsiang | |
| 7,854,687 | B2 | 12/2010 | Alexander | |
| D630,285 | S | 1/2011 | Hsiang | |
| 8,105,211 | B2 | 1/2012 | Alexander | |
| 8,303,469 | B2 | 11/2012 | Alexander | |
| 8,430,795 | B2 | 4/2013 | Publicover | |
| 8,650,724 | B2 | 2/2014 | King | |
| 8,764,610 | B2 | 7/2014 | Chen | |
| 8,790,221 | B2 | 7/2014 | Schaffer | |
| RE45,182 | E | 10/2014 | Nelson | |
| 8,905,898 | B2 | 12/2014 | Chen | |
| 8,920,290 | B2 | 12/2014 | Stokes | |
| 9,339,676 | B2 | 5/2016 | Publicover | |
| D759,773 | S | 6/2016 | Miller | |
| 9,486,658 | B2 | 11/2016 | Alexander | |
| 9,545,532 | B2 | 1/2017 | Miller | |
| 9,656,110 | B2 | 5/2017 | Alexander | |
| 9,700,748 | B2 | 7/2017 | Howe | |
| D794,150 | S | 8/2017 | Ji | |
| D794,151 | S | 8/2017 | Ji | |
| 9,873,009 | B2 | 1/2018 | Miller | |
| 10,188,925 | B2 * | 1/2019 | Freund | A63B 69/0097 |
| 10,688,372 | B2 * | 6/2020 | Chen | A63B 1/00 |
| 2002/0137598 | A1 * | 9/2002 | Publicover | A63B 5/11 482/27 |
| 2003/0064861 | A1 * | 4/2003 | Chen | A63B 5/11 482/27 |
| 2004/0107491 | A1 * | 6/2004 | Publicover | E04H 4/108 4/498 |
| 2004/0121883 | A1 | 6/2004 | Publicover | |
| 2005/0032609 | A1 | 2/2005 | Nissen | |
| 2005/0245370 | A1 | 3/2005 | Boland | |
| 2005/0075223 | A1 | 4/2005 | Wu | |
| 2005/0187082 | A1 | 8/2005 | Bowser | |
| 2005/0239618 | A1 | 10/2005 | Teng | |
| 2005/0255976 | A1 | 11/2005 | Hinds et al. | |
| 2006/0025289 | A1 | 2/2006 | Wallach | |
| 2006/0089240 | A1 | 4/2006 | Yu | |
| 2007/0000182 | A1 | 1/2007 | Boujon | |
| 2007/0004560 | A1 | 1/2007 | Nelson | |
| 2008/0009394 | A1 | 1/2008 | Van Elverdinghe | |
| 2009/0111659 | A1 | 4/2009 | Xiang | |
| 2009/0264042 | A1 * | 10/2009 | Chen | A63G 31/12 446/221 |
| 2009/0276984 | A1 | 11/2009 | Rabe | |
| 2011/0256985 | A1 | 10/2011 | Mann | |
| 2014/0069757 | A1 | 3/2014 | Schlipper | |
| 2014/0221162 | A1 | 8/2014 | Chen | |
| 2014/0371031 | A1 | 12/2014 | Allen | |
| 2015/0045188 | A1 | 2/2015 | Allen | |
| 2016/0030794 | A1 * | 2/2016 | Yang | A63B 5/11 482/27 |
| 2016/0296781 | A1 * | 10/2016 | Andon | A63B 5/11 |
| 2017/0128779 | A1 | 5/2017 | Howe et al. | |
| 2017/0173376 | A1 | 6/2017 | Miller et al. | |
| 2017/0173437 | A1 * | 6/2017 | Chen | A63B 5/11 |
| 2017/0361155 | A1 | 12/2017 | McGrane et al. | |
| 2019/0060692 | A1 | 2/2019 | Chang | |

FOREIGN PATENT DOCUMENTS

| | | | |
|---|---|---|---|
| CA | 2808984 | A1 | 9/2013 |
| CA | 2896049 | A1 | 12/2016 |
| CN | 1277592 | C | 10/2006 |
| CN | 200957263 | Y | 10/2007 |
| CN | 101102821 | A | 1/2008 |
| CN | 101332348 | A | 12/2008 |
| CN | 201848045 | U | 6/2011 |
| CN | 202237001 | U | 5/2012 |
| CN | 202446713 | U | 9/2012 |
| CN | 201147592 | Y | 11/2012 |
| CN | 202666263 | U | 1/2013 |
| CN | 202876183 | U | 4/2013 |
| CN | 302552501 | S | 8/2013 |
| CN | 203525194 | U | 4/2014 |
| CN | 101918085 | A | 5/2014 |
| CN | 103826707 | A | 5/2014 |
| CN | 103889512 | A | 6/2014 |
| CN | 204261253 | U | 4/2015 |
| CN | 105358223 | A | 2/2016 |
| CN | 106507668 | A | 3/2017 |
| CN | 107427709 | A | 12/2017 |
| CN | 206809609 | U | 12/2017 |
| CN | 207342088 | U | 5/2018 |
| DE | 9013998 | U1 | 1/1991 |
| EP | 0265440 | A1 | 5/1988 |
| EP | 1044705 | A1 | 10/2000 |
| JP | 356063465 | U | 5/1981 |
| JP | 359164654 | U | 11/1984 |
| JP | 363146666 | U | 9/1988 |
| SE | 1651023 | A1 | 2/2018 |
| WO | 02087704 | A1 | 11/2002 |
| WO | 2009/098324 | A2 | 8/2009 |
| WO | 2014/058364 | A1 | 4/2014 |
| WO | 2017/174567 | A1 | 10/2017 |

OTHER PUBLICATIONS

European search report for EP Application No. 20153445.0, entitled "Silent Performance System and Under Padding Channels in a

(56) References Cited

OTHER PUBLICATIONS

Trampoline," foreign counterpart of U.S. Appl. No. 16/750,410, filed Jan. 23, 2020, also assigned to Avera AB. Search report dated Jun. 8, 2020.
European search report for EP Application No. 20153447.6, entitled "High-Tension Safety Net in a Trampoline," foreign counterpart of U.S. Appl. No. 16/750,427, filed Jan. 23, 2020, also assigned to Avera AB. Search report dated Jun. 4, 2020.
International search report for PCT/EP2017/057961.
International search report for PCT/SE2012/051088.

* cited by examiner

HIGH-TENSION SAFETY NET IN A TRAMPOLINE

FIELD

Embodiments of the invention relate to a high-tension safety net applied to a trampoline. Embodiments of the invention further relate to a trampoline comprising such a high-tension safety net and to a method of erecting the high-tension safety net in a trampoline.

BACKGROUND

The following description includes information that may be useful in understanding embodiments of the invention. It is not an admission that any of the information provided herein is prior art or relevant to the presently claimed invention, or that any publication specifically or implicitly referenced is prior art.

The modern trampoline era began in the mid-1930s, see, e.g., U.S. Pat. No. 2,370,990 by George Nissen who with Larry Griswold was instrumental in developing the modern trampoline. Even though trampolines were initially developed for competitive or professional purposes, trampolines for recreational use are nowadays popular home entertainment accessories.

A trampoline comprises a flexible mat, a frame, and at least one resilient member. The flexible mat is typically circular, oval, square, rectangular, or stadium (e.g., rectangular with curved corners). The flexible mat may comprise a cloth or net-shaped structure. It may be made of a polymeric material, such as polypropylene. The frame, conventionally made of metal, encompasses the flexible mat and typically has substantially the same shape as the flexible mat. A circular or oval mat is typically surrounded by a circular or oval frame having a larger diameter than the flexible mat, and a square, rectangular, or stadium mat is typically surrounded by a substantially square, rectangular, or stadium frame, where stadium represents an approximately rectangular shape with rounded-off edges.

The flexible mat typically comprises a plurality of attachments distributed along the mat's edge. The attachments are adapted to receive one or more resilient members for retaining the flexible mat under tension, creating a suspension system. The resilient members may comprise a plurality of springs (e.g. helical springs) that connect the edge of the flexible mat to the frame, thereby tensioning the flexible mat. When a person is using the flexible mat, i.e. jumping on it, the springs will extend in length and thereafter strive to return to their resting length. The spring may be attached to a loop, such as a D-shaped or triangle-shaped ring, comprised in the flexible mat by means of a hook that attaches to the spring. Thus, the system of loops and D-rings comprise the plurality of attachments for the flexible mat to receive the resilient members.

In some trampoline embodiments, the resilient member may comprise an elastic cord. Normally, the elastic cord is long enough to go back and forth between the edge of the flexible mat and the frame several times. Each portion connecting the flexible mat to the frame then forms a segment, which correspond to a spring in the above example. The elastic cord may be so long, that only one elastic cord is utilized for the whole mat, or a plurality of elastic cords may be used.

The flexible mat is conventionally surrounded by an edge pad, which is adapted to at least partly cover the at least one resilient member and/or the frame. The edge pad helps prevent users from stepping or landing between the resilient members, e.g. when climbing onto the flexible mat. The edge pad may also be arranged to cover the frame, thereby reducing a possible impact with the frame in case of stepping or landing on the frame. The edge pad is often made as a number of segments, the shapes of which are adapted to the frame and the flexible mat. For a circular or oval mat, the segments may therefore be arc-shaped. For a square or rectangular mat, rectangular segments may be used. For a stadium-shaped mat, a mix of straight and curved segments may be used.

The trampoline as a whole is often covered by a safety net. The safety net is intended to prevent trampoline users from falling off the trampoline. The trampoline net is conventionally configured as a series of poles emerging vertically from the frame of the trampoline. The safety net is attached to this set of poles.

While safety has improved in trampolines in recent years, there nevertheless exists a continuous need to improve safety in the trampoline arts, especially where such improvements can be accomplished in a commercially reasonable fashion.

SUMMARY OF THE INVENTION

Embodiments of the invention provide a trampoline, comprising a frame; a flexible mat; a plurality of resilient members attached to the frame and to the flexible mat, wherein the resilient members receive kinetic energy from a user jumping on the flexible mat, causing the user to rise above a surface of the flexible mat; a plurality of safety poles attached above the frame; and a safety net having an upper high tension line attached to an upper end of each safety pole of the plurality of safety poles and having a lower high tension line attached to a mid-section of each safety pole of the plurality of safety poles, wherein a region of the safety net between the upper high tension line and the lower high tension line has a higher tension than other portions of the safety net.

The high-tension line and the lower high-tension line are each configured to withstand forces in a vertical range of 20-30 N and in a horizontal range of 40-50 N, according to an embodiment of the invention.

Embodiments of the invention may provide a top cap having a hook that has been removably mounted to a safety pole and configured to attach to a tether of the plurality of tethers attached to the upper high-tension line of the safety net.

Embodiments of the invention may provide a method for assembling a trampoline, that comprises attaching a flexible mat to a frame using a plurality of resilient members; attaching each tether of a plurality of tethers on a safety net to each safety pole of a plurality of safety poles wherein after each tether is attached to a safety pole of the plurality of safety poles, the safety pole of the plurality of safety poles is attached to a safety pole holder of a plurality of safety pole holders on the frame; and placing an edge pad on the trampoline frame and removably attaching the edge pad to the trampoline frame.

BRIEF DESCRIPTION OF THE DRAWINGS

Embodiments of the invention will be further explained by means of non-limiting examples with reference to the appended drawings. Figures provided herein may or may not be provided to scale. The relative dimensions or proportions may vary. It should be noted that the dimensions of some features of the present invention may have been exaggerated for the sake of clarity.

DETAILED DESCRIPTION OF AN EMBODIMENT OF THE INVENTION

Figure 1:
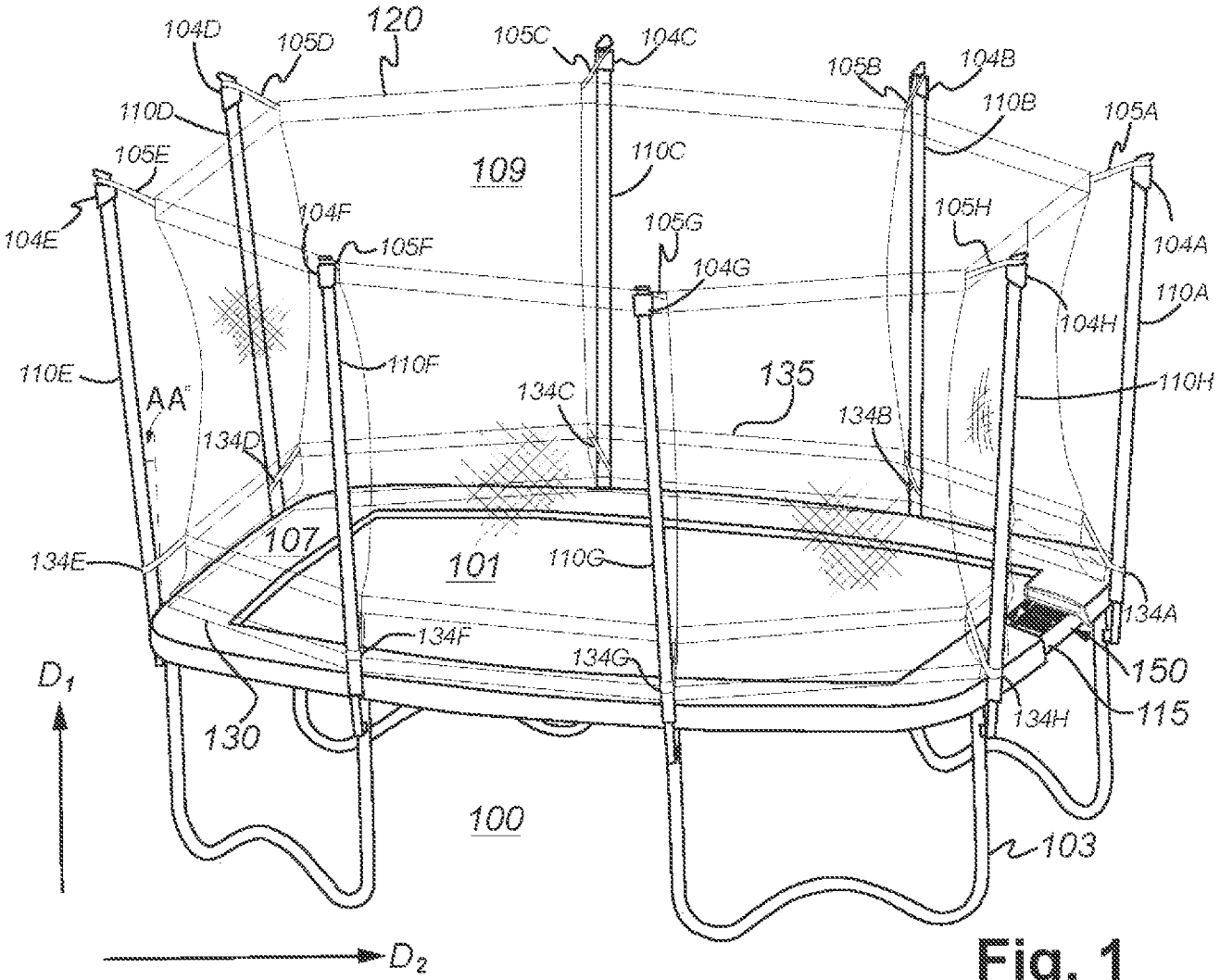
FIG. 1 illustrates a trampoline 100 having a safety net 109 held by a plurality of safety poles 110*a*-110*h*, according an embodiment of the invention.

Embodiments of the invention provide a high-tension safety net for application in a trampoline. Safety poles supporting the high-tension safety net have been configured to lean outward at a predetermined angle AA, according to an embodiment of the invention. The predetermined angle AA may be set to a range between 1 degree<AA≤20 degrees, but will most likely be set in the range between 3 degrees≤AA≤15 degrees. A preferred range for the predetermined angle AA in some embodiments of the invention lies in the range from 6 degrees≤AA≤10 degrees. Of course, in other embodiments, the safety poles may have no lean at all. The safety poles are crowned with a top cap configured to hold a tether to the high-tension safety net, according to an embodiment of the invention.

The high-tension safety net has been designed for mounting to the safety poles by a procedure that will not typically require a ladder and is intended to be accomplished by a person of normal height and possibly even below normal height, according to an embodiment of the invention. The set of top caps may be attached to the safety poles. A first top cap may be attached to a tether attached to the safety net and then the safety pole is fitted into a safety pole retainer on the trampoline frame.

Trampolines come in a variety of shapes, such as round, square, rectangular, and stadium. For substantially rectangular shaped trampolines, the trampoline assembler may wish to begin emplacing the safety poles on the trampoline's short sides. As the trampoline assembler attaches more safety poles, the tension in an upper high-tension belt in the safety net increases. For the final safety pole, or perhaps the final few safety poles, the trampoline assembler may need to use the safety pole and its specially designed top cap as a tool somewhat like a spar to snag the final tether on the safety net. The upper high tension belt of the completed safety net will now be under tension, but the level of tension should be low enough that a person of ordinary strength may lever the final safety pool into the safety pole retainer on the trampoline frame. Embodiments of the invention include a lower tensioning belt that when assembled creates a zone of higher tension between the upper portion of the safety net and the lower tensioning belt. The finally assembled safety net will bend outwards and have a high tension.

Applying a high-tension safety net to a trampoline offers numerous advantages. Among other things, a high-tension safety net offers improved safety advantages over a conventional safety net by increasing dampening properties. In other words, if a trampoline user hits the safety net, the safety net will act to dampen the trampoline user's outward movement and decrease the velocity with which the trampoline user later hits another possibly harder object such as the safety pole, which may also be covered in a shock absorbing material. In addition, the high-tension safety net will tend to direct the trampoline user's path through the air back towards the trampoline's flexible mat and away from the edge pad.

Application of a high-tension safety net in combination with other safety features, such as a zipper connecting the bottom of the safety net to the trampoline edge pad aids in separating the user from contact with the hard metal pieces of the trampoline, such as the frame.

Leaning the safety poles outward by some degree AA increases the volume area in which the trampoline user may travel, especially in comparison to some prior art solutions where the upper area of the trampoline is smaller than the lower area where the mat resides. The predetermined angle AA may be set to a range between 1 degree<AA≤20 degrees, but will most likely be set in the range between 3 degrees≤AA≤15 degrees. A preferred range for the predetermined angle AA in some embodiments of the invention lies in the range from 6 degrees≤AA≤10 degrees. Of course, in other embodiments, the safety poles may have no lean at all.

Finally, some safety regulations (e.g., national safety regulations) set minimum height requirements for safety nets and safety poles. Some trampoline assemblers may have sufficient height to assemble regulatory compliant trampoline safety nets and safety poles for smaller trampolines but may have difficulty assembling such safety nets and safety poles for larger trampolines. The safety net, safety pole, and top cap assembly and method provided by embodiments of the present invention allow a much wider group of trampoline assemblers to assemble the trampoline safety net without requiring special equipment, such as ladders, and without having to balance themselves on the edge of the trampoline, which could possibly lead to an injurious fall.

FIG. 1 illustrates a trampoline 100 having a safety net 109 held by a plurality of safety poles 110*a*-110*h*, according an embodiment of the invention. The safety poles 110*a*-110*h* lean outward by an amount AA, as shown in conjunction with the safety pole 110*e*, according to an embodiment of the invention. The predetermined angle AA may be set to a range between 1 degree<AA≤20 degrees, but will most likely be set in the range between 3 degrees≤AA≤15 degrees. A preferred range for the predetermined angle AA in some embodiments of the invention lies in the range from 6 degrees≤AA≤10 degrees. Of course, in other embodiments, the safety poles may have no lean at all or could conceivably have different leaning angles per safety pole. While the outward leaning amount could also be set at 0 degrees, an outward lean, for example of 6.5 degrees, creates a slightly wider square area at the top of the trampoline than the bottom square area of the trampoline, e.g., the flexible mat 101 and the portion of the edge pad 107 not covered by the safety net 109, according to an embodiment of the invention.

The safety net 109 is held to the safety poles 110*a*-110*h* at a high tension by the tethers 105*a*-105*h* which are attached to a plurality of top caps 104*a*-104*h* positioned at the top of the safety poles 110*a*-110*h*, according to an embodiment of the invention. The safety net 109 includes an upper high-tension line 120 that resides at the top end of the safety net 109 and comprises a stronger material than the netting fabric that comprises the body of the safety net 109. The tethers 105*a*-105*h* have been securely attached to the upper high-tension line 120 by a method such as sewing, gluing, hermetically sealing, snapping, or buttoning. Embodiments of the upper high-tension line 120 may be configured to withstand forces in the vertical range of 20-30 N and in the horizontal range of 40-50 N, according to an embodiment of the invention.

The safety net 109 may also include a lower high-tension line 135 that also acts to stiffen the safety net 109 in a manner similar to the upper high-tension line 120, according to an embodiment of the invention. Embodiments of the lower high-tension line 135 may be configured to withstand forces in the vertical range of 20-30 N and in the horizontal range of 40-50 N, according to an embodiment of the invention. Thus, the portions of the safety net 109 between the upper high-tension line 120 and the lower high-tension line 135 may be held much tighter than portions of the safety net 109 outside these two high-tension lines 120, 135, according to an embodiment of the invention. These higher tensioned portions of the safety net 109 generally direct the bodies of trampoline users that strike them during trampoline operation back towards the flexible mat 101. In a sense, the trampoline users may to some extent bounce off the safety net 109 (although the safety net 109 is not generally intended as a substitute for the flexible mat 101), according to an embodiment of the invention. For sake of clarity, the upper high-tension line 120 and the lower high tension line 130 may also be considered to be belts, bands, and other synonymous terms designating an area of the safety net typically comprising a stronger and more durable material than the netting material or fabric that comprises much of the safety net 109, according to an embodiment of the invention.

As shown in FIG. 1, the trampoline 100 comprises the flexible mat 101, a frame 115, a plurality of resilient members 150, illustrated as helical springs, and an edge pad 107. A portion of the edge pad 107 has been removed to show the resilient members 150. The frame 115 is supported by a plurality of legs 103. The legs 103 are shown as integral leg units comprising a joined pair of legs attached at the corners of the frame 115; the legs 103 need not be joined into single pieces but could comprise other arrangements, such as individual straight legs.

The resilient members 150 comprise a suspension system between the flexible mat 101 and the frame 115 for the trampoline 100. Trampoline users jump or bounce on the flexible mat 101 in a vertical direction $D_1$ and possibly also move in a horizontal direction $D_2$ perpendicular to the first direction $D_1$. As trampoline users move in the horizontal direction $D_2$, they are at risk of falling off the trampoline 100 and injuring themselves. The safety net 109 acts to hold trampoline users onto the trampoline 100. As trampoline users move in the horizontal direction $D_2$, they are also at risk of hitting or landing on one of the trampoline's harder parts, such as the frame 115 or the safety poles 110*a*-110*h*, and/or one of the trampoline's moving parts, such as the resilient members 150 of the trampoline's suspension system. The safety net 109 also acts to prevent trampoline users from engaging with these parts as well.

The safety net 109 may have a connector 130 to the edge pad 107. The connector 130 is likely a removeable connection such as a zipper, buttons, belt, string, rope, snaps, or Velcro. The connector 130 acts to prevent body parts of trampoline users from extending outside the region of the safety net 109 and the edge pad 107 and possibly having a harmful engagement with a trampoline part such as the frame 115 or the resilient members 150.

Since trampoline users could possibly land on the suspension system and become injured, the edge pad 107 lies on top of the suspension system comprising the resilient members 150 to protect trampoline users from harm as they jump on the flexible mat 101. The fabric of the flexible mat 101 that users jump or bounce on is often not elastic itself, instead the resilient members 150 (e.g., helical springs) provide the elasticity which creates the potential energy. The edge pad 107 generally serves to reduce the severity of impact injuries.

Figure 2:
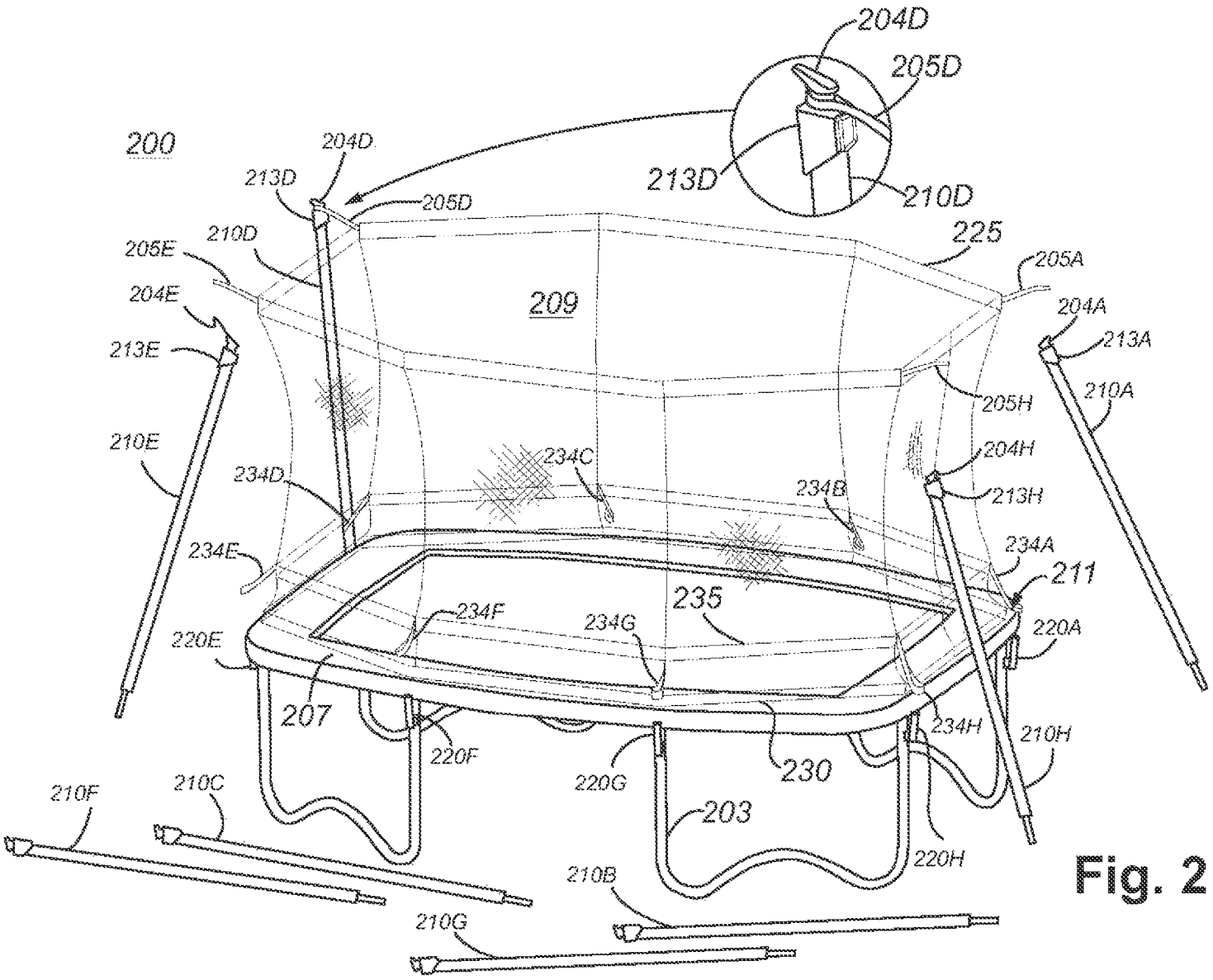
FIG. 2 illustrates a trampoline 200 having a safety net 209 held by a plurality of safety poles 210*a*-210*h*, according an embodiment of the invention.

FIG. 2 illustrates a trampoline 200 having a safety net 209 to be held by a plurality of safety poles 210*a*-210*h* by the end of the trampoline 200's assembly, according an embodiment of the invention. The safety net 209 is held to the poles 210*a*-210*h* at a tension due to the tethers 205*a*-205*h* which are fastened to a plurality of hooks 204*a*-204*h* positioned on top caps 213*a*-213*h* at the top of the possibly outward leaning safety poles 210*a*-210*h*, according to an embodiment of the invention. Safety poles 210*b*, 210*c*, 210*f*, and 210*g* have not been shown in their assembled position in FIG. 2 in order not to obscure the safety poles shown 210*a*, 210*d*, 210*e*, and 210*h* as an aid to clarifying the operation of the top caps 213*a*-213*h*, their hooks 204*a*-204*h* and the tethers 205*a*-205*d*. Depending on the specific shape and dimensions of the frame 211, the trampoline 200 might have more or fewer safety poles than the safety poles 210*a*-210*h*. The number of safety poles required for a trampoline relates to the number of safety poles needed to hold up the safety net 209 securely, the desired strength of the safety net 209, the dimensions of the trampoline 200, possibly safety regulations, and other factors known to those of ordinary skill in the trampoline arts.

The safety net 209 includes an upper high-tension line 225 that resides at the top end of the safety net 209 and comprises a stronger material than the netting fabric that comprises the body of the safety net 209. The tethers 205*a*-205*h* have been securely attached to the high-tension line 225 by a method such as sewing, gluing, hermetically sealing, snapping, or buttoning. Embodiments of the upper high-tension line 225 may be configured to withstand forces in the vertical range of 20-30 N and in the horizontal range of 40-50 N, according to an embodiment of the invention.

FIG. 2 illustrates how the safety net 209 may be placed under tension. A trampoline assembly worker may place top caps 213*a*-213*h* on safety poles 210*a*-210*h*. The trampoline assembly worker may then take the tethers 205*a*-205*h* from the safety net 209 and hook the tethers 205*a*-205*h* to a respective hook 204*a*-204*h* on the top caps 213*a*-213*h*, according to an embodiment of the invention.

As shown by the exploded view of the top cap 213*d* in FIG. 2, the tether 205*d* may include a loop portion that can be fit over the hook 204*d* on the top caps 213*d*, according to an embodiment of the invention. The other tethers 204*a*-204*h* may include similar loops and the other top caps 213*a*-213*h* may also include hooks 204*a*-204*h*, according to an embodiment.

After the trampoline assembly worker has attached a tether of the tethers 205*a*-205*d* to a hook of the hooks 204*a*-204*d* of the safety caps 205*a*-205*d*, the trampoline assembly worker may attach (or insert) the respective safety pole of the safety poles 210*a*-210*h* into a respective safe pole holder of the safety pole holders 220*a*-220*h* attached to the frame 211. The trampoline assembly worker should preferably attach the safety poles 210*a*-210*h* to the safety pole holders 220*a*-220*h* such that the net 209 ends up smooth and not crisscrossed. So, for example the safety pole 210*a* having the top cap 213*a* with its top cap 204*a* attached to the tether 205*a* of the safety net 209 will be placed into the safety pole holder 220*a*.

As the trampoline assembly worker continues to attach one safety pole after another into its respective safety pole holder (e.g., the safety pole 210*a* into the safety pole holder 220*a* then the safety pole 210*b* into the safety pole holder 220*b*), the tension in the safety net 209 will begin to increase. As mentioned above, embodiments of the upper high-tension line 220 once assembled may be configured to withstand forces in the vertical range of 20-30 N and in the horizontal range of 40-50 N.

When the top cap 204*h* of the last safety pole 210*h* needs to be attached to the last tether 205*h*, the safety net 209 will no longer be loose and will be raised fairly high, such that the tether 205*h* may likely be out of reach for many trampoline assembly workers.

Rather than having to climb a ladder, the trampoline assembly worker may attach the final tether 205*h* to the top cap 213*h* by applying the following procedure. The trampoline assembly worker may verify that the top cap 213*h* has been placed securely on the pole 210*h*. The trampoline assembly worker may then hold the pole 210*h* at an angle and use the top cap 213*h* to capture the tether 205*h*. (The safety pole 210*a* is shown at an angle that may be acceptable for capturing the tether 205*a*.) If the embodiment of the top cap 213*h* includes a hook, such as the hook 204*d* shown in FIG. 2, then the trampoline assembly worker may simply swoop (or wedge) the hook into the tether 205*h*. Once the tether 205*h* has been secured to the top cap 213*h*, then the trampoline assembly worker may hoist the pole 210*h* up and into its respective pole holder 220*h*, according to an embodiment of the invention.

As the trampoline assembly worker hoists the final safety pole 210*h* into the safety pole holder 220*h*, the trampoline assembly worker should observe that the safety net 209 is now under tension. The amount of tension, while higher than conventional trampoline nets, should be lower enough that a person of average strength should be able to place the final safety pole 210*h* into the safety pole holder 220*h*, according to an embodiment of the invention. The trampoline assembly worker will typically be standing on the ground while place the final pole 210*h* into the pole holder 220*h*. Particularly petite trampoline assembly workers may need to use a step stool or short ladder in order to be sufficiently tall to place the final safety pole 210*h* into the safety pole holder 220*h*. Of course, the height of the trampoline assembly worker for unaided assembly somewhat depends on the height of the legs 203.

The procedure described above may be performed in a variety of ways in terms of the order that the safety poles 210*a*-210*h* are inserted into the safety pole holders 220*a*-220*h*. For example, the safety poles 210*a*-210*h* may be assembled in a clockwise or counterclockwise manner. Some trampolines like the trampoline 200 are essentially rectangular while other trampolines may be square, circular, or stadium. For trampolines having a rectangular shape where one side is longer than another side, the trampoline assembly worker may want to place the safety poles of the shorter sides into the safety pole holders before inserting the safety poles on the longer sides of the trampoline. This procedure may be simpler for the trampoline assembly worker and lead to a better result. Thus, in the trampoline 200, the trampoline assembly worker might opt to insert the safety poles 210*a*, 210*h*, 210*e*, and 210*d* before inserting the safety poles 210*f*, 210*g*, 210*b*, and 210*c*, leaving one of the safety poles 210*f*, 210*g*, 210*b*, or 210*c* as the final safety pole to be inserted into its respective safety pole holder.

Once the safety net 209 has been raised and attached to the safety poles 210*a*-210*h*, then the trampoline assembly worker may want to attach a lower high-tension line 235 to the safety poles 210*a*-210*h*. The lower high-tension line includes a number of tethers 234*a*-234*h* that attach to the safety poles 210*a*-210*h*. The tethers 234*a*-234*h* may be attached to the safety poles 210*a*-210*h* in a number of ways. For example, the safety poles 210*a*-210*h* may include a lower hook or catch to which the tethers 234*a*-234*h* may attach, according to an embodiment of the invention.

As shown in FIG. 2, the trampoline 200 comprises a flexible mat 201, the frame 211, an edge pad 207, a plurality of resilient members (covered in FIG. 2 by the edge pad 207 but similar to the resilient members 150 shown in FIG. 1). The frame 211 is supported by a plurality of legs 203.

The resilient members comprise a suspension system between the flexible mat 201 and the frame 211 for the trampoline 200. Trampoline users jump or bounce on the flexible mat 201 in a vertical direction and possibly also move in a horizontal direction perpendicular to the first direction. The resilient members comprise a suspension system between the flexible mat 201 and the frame 211 for the trampoline 200.

As trampoline users move in the horizontal direction, they are at risk of falling off the trampoline 200 and injuring themselves. The safety net 209 acts to hold trampoline users onto the trampoline 200. As trampoline users move in the horizontal direction, they are also at risk of hitting or landing on one of the trampoline's harder parts, such as the frame 211 or the safety poles 210*a*-210*h*, and/or one of the trampoline's moving parts, such as the resilient members of the trampoline's suspension system. The safety net 209 also acts to prevent trampoline users from engaging with these parts as well.

The safety net 209 may have a connector 230 to the edge pad 207. The connector 230 is likely a removeable connection such as a zipper, buttons, belt, string, rope, snaps, or Velcro. The safety net 209 may also include a lower tension line 235 that also acts to stiffen the safety net 209, according to an embodiment of the invention.

The edge pad 207 lies on top of the suspension system comprising the resilient members to protect trampoline users from harm as they jump on the flexible mat 201 since they could possibly land on the suspension system and become injured. The fabric of the flexible mat 201 that users jump or bounce on is often not elastic itself, instead the resilient members (e.g., helical springs) provide the elasticity which creates the potential energy. The edge pad 207 generally serves to reduce the severity of impact injuries. The thickness of the flexible mat 201 is typically in the range of 0.2 mm to 1 mm. However, the flexible mat 201 is usually reinforced at its edge, resulting in a higher thickness at the edge of the flexible mat 201.

Figure 3:
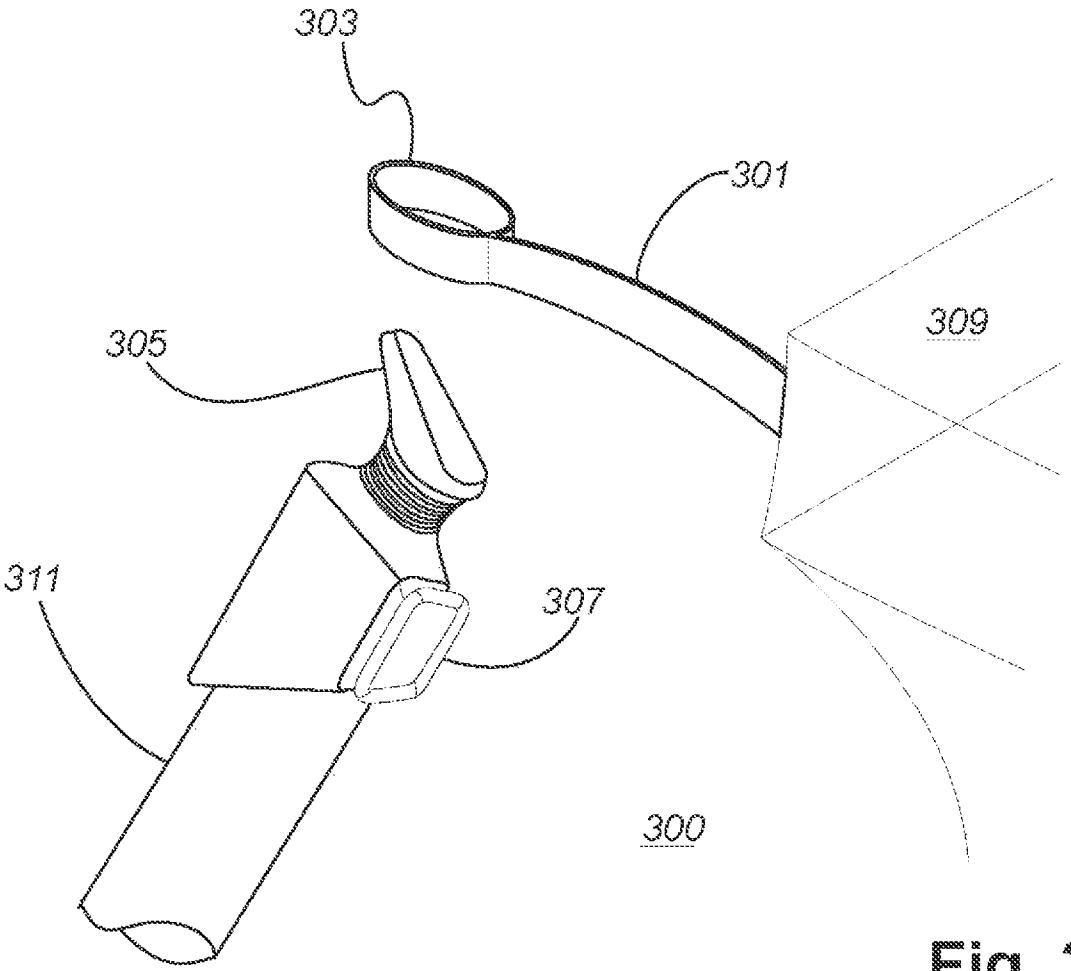
FIG. 3 provides an exploded view of a top cap 307 for a trampoline 300 that may facilitate attaching a safety net 309 to a safety pole 311, according to an embodiment of the invention.

FIG. 3 provides an exploded view of a top cap 307 for a trampoline 300 that may facilitate attaching a safety net 309 to a safety pole 311, according to an embodiment of the invention. The top cap 307 includes a hook 305 that facilitates attaching a loop 303 of a tether 301 that itself attaches to the safety net 309, according to an embodiment of the invention. The process by which a trampoline assembly worker can go about attaching the safety net 309 to a plurality of safety poles 311 has been described in connection with FIG. 2 and will be further discussed here.

As shown in FIG. 3, the safety net 309 includes the loop 303 attached to the net 309 by the tether 301. The pole 311 includes a top cap 307. The top cap 307 includes the hook 305. The trampoline assembly worker captures the loop 303 by placing the hook 305 through the loop 303. Once the pole 311 has been placed into a pole holder, such as the pole holder 220*a* shown in FIG. 2, then the safety net 309 will be at increased tension.

The trampoline 300 will likely include a plurality of safety poles 311, according to an embodiment of the invention. For many of the safety poles first assembled with a connection to the safety net 309, the trampoline assembly worker will likely be able to fit the loop 303 onto the hook 305 by hand, and then lift the safety pole into its respective safety pole holder, as described in FIG. 2. For the last safety pole or safety poles to be attached to the safety net 309, the safety net 309, having been raised by the preceding safety poles, may now have a tether that is too high to reach by hand and attach to the hook of the top cap by hand. For these safety net attachments, the trampoline assembly worker, may place the top cap (e.g., the top cap 307) onto the safety pole (e.g., the safety pole 311) and then hold the safety pole at an angle and use the hook 305 to capture the loop 303. Once the loop 303 has been captured, then the trampoline assembly worker may straighten the safety pole and guide it into its respective safety pole holder, according to an embodiment of the invention. If the final safety pole is under a great deal of tension, then the trampoline assembly worker may guide the pole into the final safety pole holder (e.g., the safety pole holder 220*a* shown in FIG. 2) and then bend the safety pole outward himself to the angle AA (e.g., 6.5 degrees). In other words, the trampoline assembly worker may apply torque to the safety pole to cause it to rotate in the safety pole holder, according to an embodiment of the invention. The need for the safety pole assembly worker to take extra steps in completing the final safety pole likely depends on the construction of the trampoline and safety net as well as the overall physical strength of the trampoline assembly worker.

Figure 4:
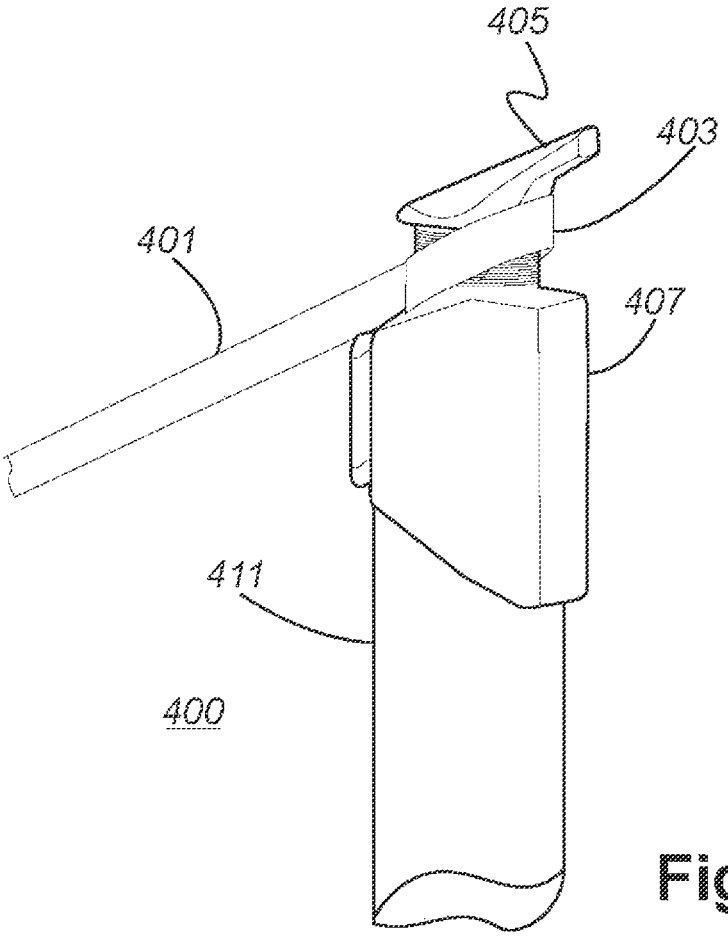
FIG. 4 illustrates a loop 403 attached to a tether 401 of a safety net 409 that has been captured by a hook 405 on a top cap 407 of a safety pole 411, according to an embodiment of the invention.

FIG. 4 illustrates a loop 403 attached to a tether 401 of a safety net that has been captured by a hook 405 on a top cap 407 of a safety pole 411, according to an embodiment of the invention.

Once the hook 405 has captured the loop 403, then the safety pole 411 may be placed in a safety pole holder, such as the safety pole holder 220*a* shown in FIG. 2. Once the safety pole 411 has been placed in a pole holder, then the strap 401 will be held at increased tension which will pull the safety net tighter, according to an embodiment of the invention. As discussed in connection with the upper high-tension line 225 of the safety net 209 shown in FIG. 2, the upper high-tension line 225 once assembled may be configured to withstand forces in the vertical range of 20-30 N and in the horizontal range of 40-50 N, according to an embodiment of the invention.

Figure 5:
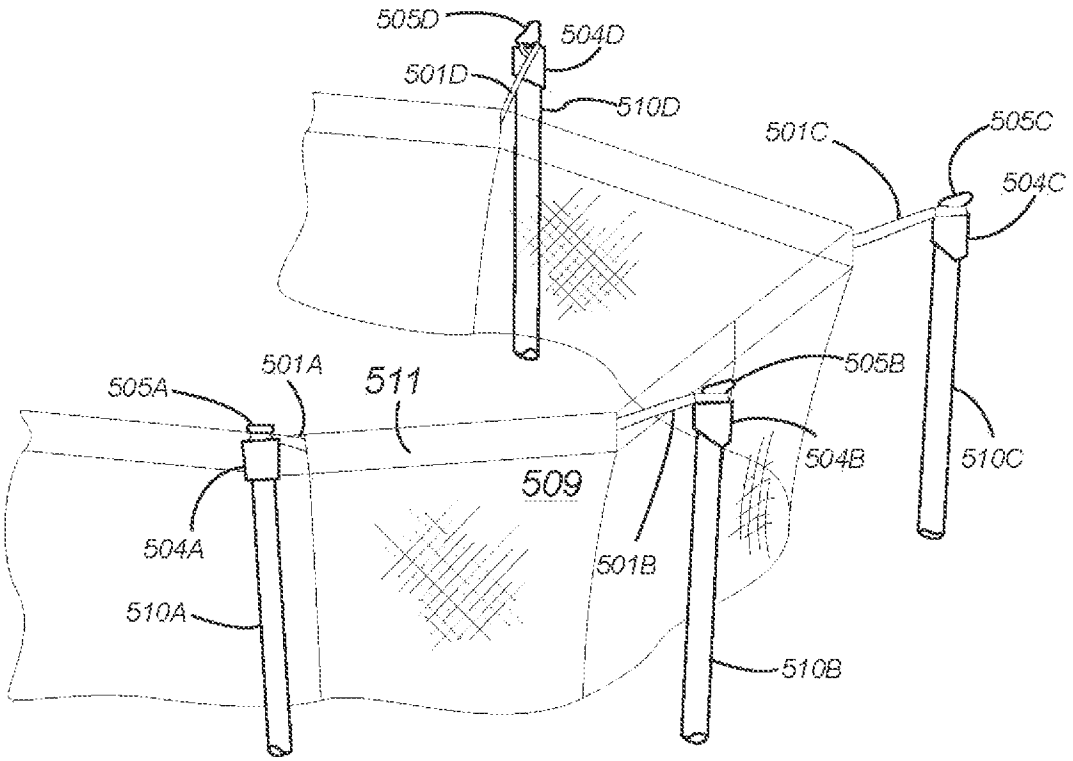
FIG. 5 provides a close-up view of a trampoline 500 having a series of top caps 504*a*-504*d* having hooks 505*a*-505*d* that have been secured to tethers 501*a*-501*d* creating tension in a high-tension line 511 of a safety net 509, according an embodiment of the invention.

FIG. 5 provides a close-up partial view of a trampoline 500 having safety poles 510*a*-510*d* having a series of top caps 504*a*-504*d* with hooks 505*a*-505*d* that have been secured to tethers 501*a*-501*d* creating tension in an upper high-tension line 511 of a safety net 509, according an embodiment of the invention.

As the trampoline assembly worker attaches the tethers 501*a*-501*d* to the hooks 505*a*-505*d*, the trampoline assembly worker may next attach the safety poles 510*a*-510*d* into a respective safety pole holder, such as the safety pole holder 220*a* shown in FIG. 2. So, for example the safety pole 510*a* having the top cap 504*a* with its hook 505*a* attached to the loop 501*a* of the safety net 509 will be placed into a safety pole holder, such as the safety pole holder 220*a* shown in FIG. 2.

As the trampoline assembly worker continues to attach one safety pole 510*a* after another safety pole 510*b* into its respective pole holder, the tension in the net 509 will begin to increase, especially on the upper high-tension line 511. As mentioned in connection with the upper high-tension line 220 shown in FIG. 2, embodiments of the upper high-tension line 511 once assembled may be configured to withstand forces in the vertical range of 20-30 N and in the horizontal range of 40-50 N.

When the hook 505*d* of the last pole 510*d* needs to be attached to the last loop 501*d*, the safety net 509 will no longer be loose and the high-tension line 511 will be raised higher than it was in the early phases of assembly, such that the loop 501*d* may likely be out of reach for many trampoline assembly workers. (Note: this example assumes that the trampoline assembly worker has also attached the safety net 509 to the safety poles not shown in FIG. 5.)

Rather than having to climb a ladder or climb onto the trampoline 500, the trampoline assembly worker may attach the final loop 501*d* to the hook 505*d* by following the following procedure. The trampoline assembly worker may verify that the top cap 504*d* having the hook 505*d* has been placed securely on the pole 510*d*. The trampoline assembly worker may then hold the pole 510*d* at an angle and use the hook 505*d* to capture the loop 501*d*. For example, the trampoline assembly worker may swoop (or wedge) the hook 505*d* into the loop 501*d*. Once the loop 501*d* has been secured to the hook 505*d*, then the trampoline assembly worker may hoist the pole 510*d* up and into its pole holder.

As the trampoline assembly worker hoists the final pole 510*d* into its respective safety pole holder, the trampoline assembly worker should notice that the upper high-tension line 511 of the safety net 509 is now under tension. As mentioned in connection with the upper high-tension line 220 shown in FIG. 2, embodiments of the upper high-tension line 220 once assembled may be configured to withstand forces in the vertical range of 20-30 N and in the horizontal range of 40-50 N. The amount of tension in the upper high-tension line 511, while higher than conventional trampoline nets, should be low enough that a person of average strength should be able to place the safety pole 510*d* into its respective safety pole holder, e.g., the safety pole holder 220*d* shown in FIG. 2.

The trampoline assembly worker will typically be standing on the ground while place the final pole 510*d* into its respective safety pole holder. Particularly petite trampoline assembly workers may need to use a step stool or short ladder in order to be sufficiently tall to place the final pole 510*d* into the safety pole holder. Of course, the height of the trampoline assembly worker for unaided assembly somewhat depends on the height of the legs of the trampoline 500.

Figure 6:
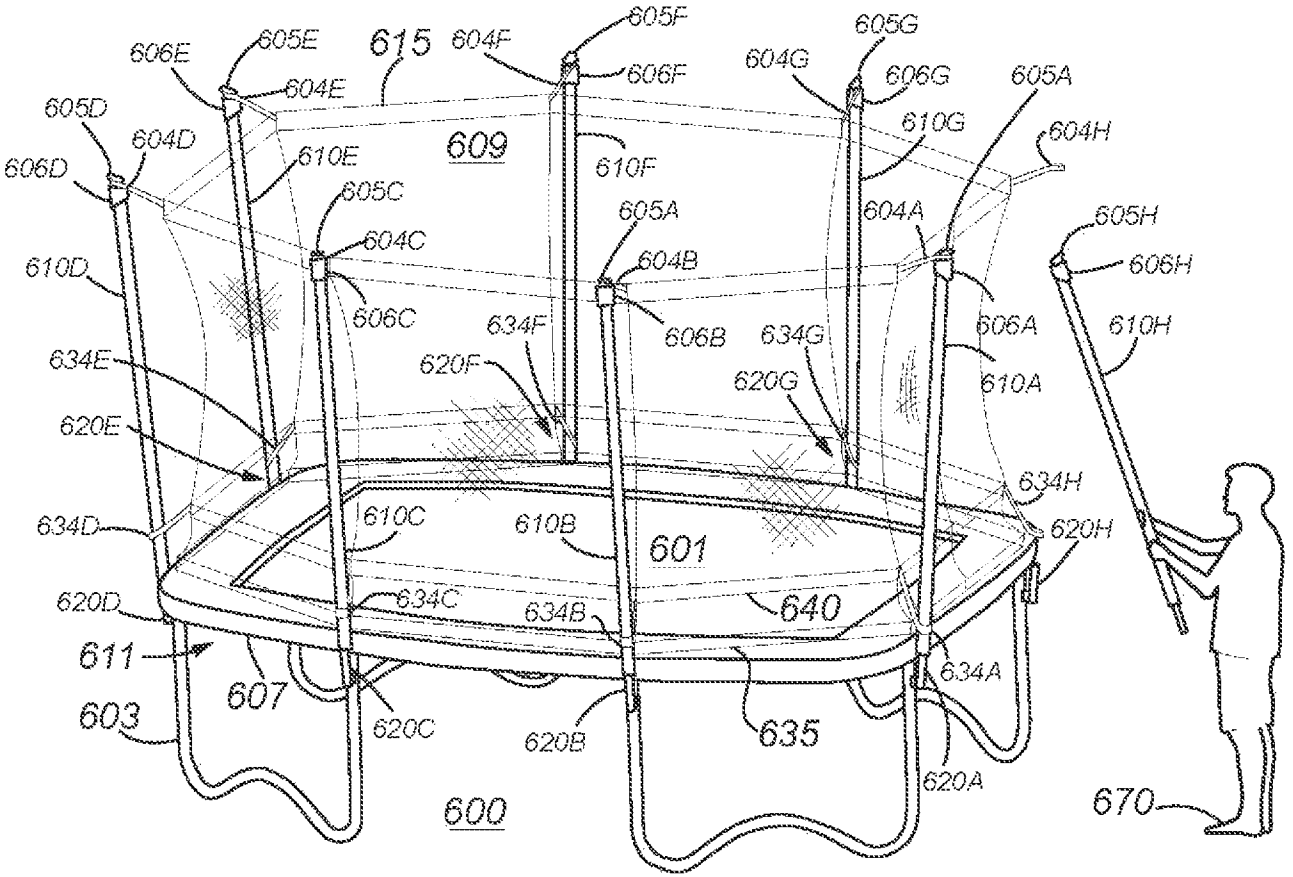
FIG. 6 illustrates a trampoline 600 having a safety net 609 held by a plurality of safety poles 610*a*-610*h*, according an embodiment of the invention.

FIG. 6 illustrates a trampoline 600 having a safety net 609 held by a plurality of safety poles 610*a*-610*h*, according an embodiment of the invention. The safety net 609 is held to the safety poles 610*a*-610*h* at a tension due to the tethers 604*a*-604*h* held at a tension to a plurality of hooks 605*a*-

605*h* formed as part of top caps 606*a*-606*h* positioned at the top of the safety poles 610*a*-610*h*, according to an embodiment of the invention.

As shown in FIG. 6, the trampoline 600 comprises a flexible mat 601, a frame 611 and an edge pad 607. Not shown in FIG. 6 are the resilient members (e.g., helical springs) that would reside below the edge pad 607. The resilient members 150 have been shown in FIG. 1 and need be no different for the trampoline 600. The frame 611 is supported by a plurality of legs 603.

FIG. 6 illustrates trampoline assembly worker 670 who has already attached the tethers 604*a*-604*g* to the hooks 605*a*-605*g* of the top caps 606*a*-606*g* and attached the safety poles 610*a*-610*g* into a respective safety pole holder 620*a*-620*g*. As the trampoline assembly worker 670 attached one safety pole after another safety pole into its respective safety pole holder, the tension in the safety net 609 began to increase, especially on an upper high-tension line 615. The upper high-tension line 615 once assembled may be configured to withstand forces in the vertical range of 20-30 N and in the horizontal range of 40-50 N, according to an embodiment of the invention.

When the hook 605*h* of the last safety pole 610*h* needs to be attached to the last tether 604*h*, the safety net 609 will no longer be loose and the high-tension line 615 will be raised fairly high, such that the tether 604*h* is likely be out of reach for many trampoline assembly workers, such as the trampoline assembly worker 670.

Rather than having to climb a ladder or climb onto the trampoline 600, the trampoline assembly worker 670 may attach the final tether 604*h* to the hook 605*h* by applying the following procedure. The trampoline assembly worker 670 may verify that the top cap 606*h* having the hook 605*h* has been placed securely on the safety pole 610*h*. The trampoline assembly worker 670 may then hold the safety pole 610*h* at an angle and use the hook 605*h* to capture the tether 604*h*. For example, the trampoline assembly worker 670 may swoop (or wedge) the hook 605*h* up and into the tether 604*h* by lifting the safety pole 610*h*, turning the hook 605*h* to face the tether 604*h* and then pulling the hook 605*h* into the tether 604*h*. Once the tether 604*h* has been secured to the hook 605*h*, then the trampoline assembly worker 670 may hoist the pole 610*h* up and into the pole holder 620*h*.

As the trampoline assembly worker hoists the final pole 610*h* into the safety pole holder 620*h*, the trampoline assembly worker 670 should notice that the high-tension line 615 of the safety net 609 is now under higher tension. The amount of tension, while higher than conventional trampoline nets, should be low enough that a person of average strength should be able to place the safety pole 610*h* into its safety pole holder 620*h*. If the final safety pole is under a great deal of tension, then the trampoline assembly worker 670 may guide the safety pole 610*h* into the final safety pole holder 620*h* and then bend (or rotate) the safety pole 610*h* outward himself to the angle AA (e.g., 6.5 degrees). In other words, the trampoline assembly worker 670 may apply torque to the safety pole 610*h* to cause it to rotate in the safety pole holder 620*h*, according to an embodiment of the invention. The need for the safety pole assembly worker 670 to take extra steps in completing the final safety pole 610*h* likely depends on the construction of the trampoline 600 and safety net 609 as well as the overall physical strength of the trampoline assembly worker 670.

The trampoline assembly worker 670 will typically be standing on the ground while placing the final safety pole 610*h* into the safety pole holder 620*h*. Particularly petite trampoline assembly workers may need to use a step stool or short ladder in order to be sufficiently tall to place the final safety pole 610*h* into the safety pole holder 620*h*. Of course, the height of the trampoline assembly worker 670 for unaided assembly somewhat depends on the height of the legs 603 of the trampoline 600.

The trampoline assembly worker 670 may next assemble a lower high-tension line 640 on the safety net 609 to the safety poles 610*a*-610*h*, according to an embodiment of the invention. The lower high-tension line 640 includes a number of tethers 634*a*-634*h* that may be removably attached to the safety poles 610*a*-610*h*, according to an embodiment of the invention. The tethers 634*a*-634*h* may be attached to the safety poles 610*a*-610*h* by a variety of mechanisms, such as an attachment point on the safety poles 610*a*-610*h*, according to an embodiment of the invention. The lower high-tension line 640 once assembled may be configured to withstand forces in the vertical range of 20-30 N and in the horizontal range of 40-50 N, according to an embodiment of the invention.

The trampoline assembly worker 670 may also attach a connector 635 at a bottom portion of the safety net 609 to the edge pad 607, according to an embodiment of the invention. The connector 635 may include a removeable connection mechanism such as a zipper, buttons, belt, string, rope, snaps, or Velcro. The connector 635 may prevent trampoline users from extending bodily parts outside the trampoline, according to an embodiment of the invention.

Figure 7A:
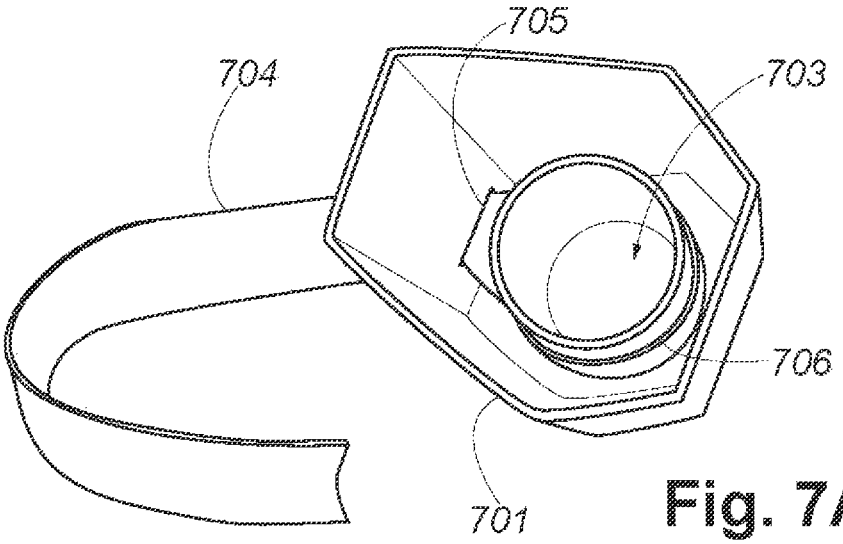
FIGS. 7A-7B illustrate a top cap 701, according to an alternative embodiment of the invention.
Figure 7B:
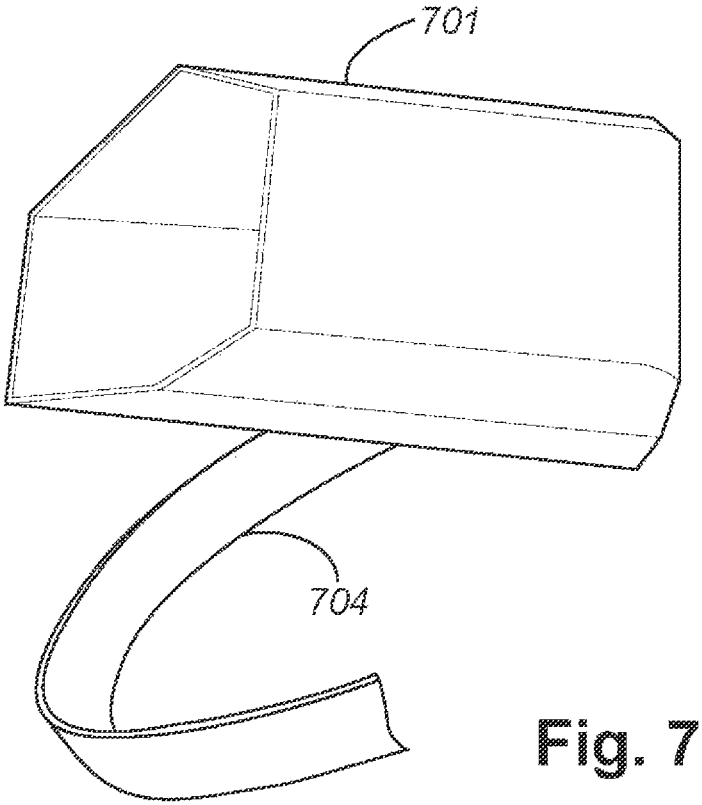

FIGS. 7A-7B illustrate a top cap 701, according to an alternative embodiment of the invention. The top cap 701 does not include a hook for capturing the tether of the safety net, such as the hook 405 of the top cap 407 shown in FIG. 4. The top cap 701 includes an internal hollow cylinder attachment 703 that allows the top cap 701 to be attached securely to a safety pole, such as the safety pole 110*a* shown in FIG. 1. The top cap 701 includes an opening 705 through which a tether 704 may be placed. The tether 704 may be attached to a safety net, such as the safety net 109 shown in FIG. 1. The tether 704 includes a loop 706. The loop 706 may be attached to the top cap 701 by fitting the loop 706 over the internal hollow cylinder attachment 703. The other end of the tether 704 attaches to a safety net, such as the safety net 109 shown in FIG. 1. The tether 704 may be attached to the net by gluing, sewing, or some other permanent or semi-permanent means that is sufficiently strong to hold when the net is placed under pressure, not only from final assembly in the trampoline by users as they hit the net while using the trampoline.

In terms of assembling the safety net to the safety poles using the top cap 701, the optimal procedure would likely be a little different than the method shown in FIG. 6. Using top caps like the top cap 701, the trampoline assembly worker would likely attach the loops 706 of all the top caps 701 around all the internal hollow cylinder attachment 703. Thus, the safety net would have all the top caps attached before the top caps were attached to the safety poles. For some number of safety poles, the trampoline assembly worker could simply place the safety pole into the internal cylinder of the internal hollow cylinder attachment 703 of the top tap 701. Once this had been accomplished, the trampoline assembly worker would then place the safety pole into its respective safety pole holder on the trampoline frame. As the trampoline assembly worker continues this procedure, the safety net will begin to rise above the trampoline frame. At some point the remaining top caps 701 should be hanging from the tethers 704. The trampoline assembly worker may use the safety pole like a spear to push the safety pole into the internal cylinder on the internal hollow cylinder attachment. As the trampoline assembly worker pushes the safety pole into the internal hollow cylinder attachment, the top cap will rise until the tether 704 is taught at which point the safety pole will be engaged with the internal hollow cylinder attachment. The trampoline assembly worker may then place the safety pole into its respective holder, according to an embodiment of the invention.

Figure 8:
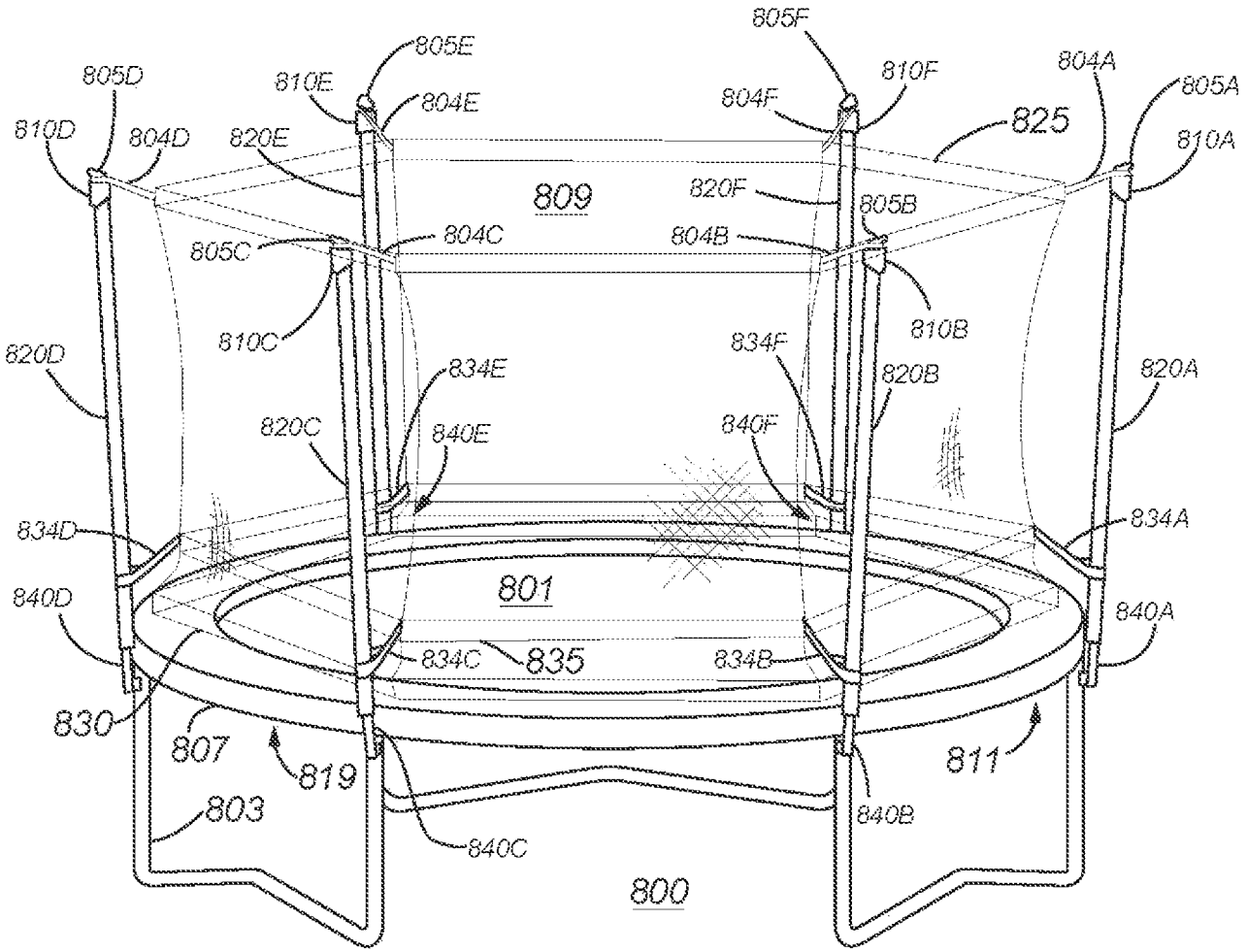
FIG. 8 illustrates a trampoline 800 having a safety net 809 held by a plurality of safety poles 820*a*-820*f*, according an embodiment of the invention.

FIG. 8 illustrates a trampoline 800 having a safety net 809 held by a plurality of safety poles 820*a*-820*f*, according an embodiment of the invention. The trampoline 800 has a substantially round shape, according to an embodiment of the invention. The safety net 809 includes an upper high-tension line 825 and a lower high-tension line 835. The lower tension line 835 may be secured once the safety net 809 has been assembled and placed in safety pole holders 840*a*-840*f*.

The safety net 809 is held to the poles 820*a*-820*f* at a tension due to the tethers 804*a*-804*f* held at a tension to a plurality of hooks 805*a*-805*f* positioned at the top of the top caps 810*a*-810*f*, according to an embodiment of the invention.

As shown in FIG. 8, the trampoline 800 comprises a flexible mat 801, a frame 811, and an edge pad 807. Below the edge pad resides the trampoline's suspension system, a plurality of a resilient members, such as the resilient members 150 shown in FIG. 1. The frame 811 is supported by a plurality of legs 803. The resilient members comprise a suspension system between the flexible mat 801 and the frame 811 for the trampoline 800. The edge pad 807 lies on top of the suspension system comprising the resilient members to protect trampoline users from harm as they jump on the flexible mat 801 since they could possibly land on the suspension system and become injured. The fabric of the flexible mat 801 that users jump or bounce on is often not elastic itself, instead the resilient members (e.g., helical springs) provide the elasticity which creates the potential energy. The edge pad 807 generally serves to reduce the severity of impact injuries.

The safety net 809 is held by a plurality of safety poles 820*a*-820*f*, according an embodiment of the invention. The safety net 809 is held to the safety poles 820*a*-820*f* at a high tension by the tethers 804*a*-804*f* which are attached to a plurality of top caps 810*a*-810*f* positioned at the top of the safety poles 820*a*-820*f*, according to an embodiment of the invention.

The safety net 809 includes an upper high-tension line 825 that resides at the top end of the safety net 809 and comprises a stronger material than the netting fabric that comprises the body of the safety net 809. The tethers 804*a*-804*f* have been securely attached to the high-tension line 825 by a method such as sewing, gluing, hermetically sealing, snapping, or buttoning.

The safety net 809 may also include a lower high-tension line 835 that also acts to stiffen the safety net 809, according to an embodiment of the invention. The lower high-tension line 835 may be held to the safety poles 820*a*-820*f* by a number of tethers 834*a*-834*f*. The tethers 834*a*-834*f* have been securely attached to the lower high-tension line 835 by a method such as sewing, gluing, hermetically sealing, snapping, or buttoning.

The upper high-tension line 825 and the lower high-tension line 835 act to create an area of higher tension in the safety net 809. Embodiments of the upper high-tension line 825 and the lower high-tension line 835 may each be configured to withstand forces in the vertical range of 20-30 N and in the horizontal range of 40-50 N, according to an embodiment of the invention.

The safety net 809 acts to hold trampoline users onto the trampoline 800. As trampoline users move in the horizontal direction, they are also at risk of hitting or landing on one of the trampoline's harder parts, such as the frame 811 or the safety poles 820*a*-820*f*, and/or one of the trampoline's moving parts, such as the resilient members of the trampoline's suspension system. The safety net 809 also acts to prevent trampoline users from engaging with these parts as well. The safety net 809 may have a connector 830 to the edge pad 807. The connector 830 is likely a removeable connection such as a zipper, buttons, belt, string, rope, snaps, or Velcro.

Embodiments of the invention may comprise a kit that is provided to the user in the form of a series of parts, such as a flexible mat, an edge pad, a frame (possibly in a number of pieces), a plurality of resilient members, and a safety layer. Instructions for assembling a trampoline comprising these parts can be provided to the user.

The trampolines described herein are amenable to assembly, particularly assembly outside of the factory where they were made such as by a user or a delivery person. The assembly can typically be accomplished by hand or with a minimum number of tools, according to an embodiment of the invention. The legs (e.g., the legs 803 shown in FIG. 8) are typically attached to the frame (e.g., the frame 811. The resilient members (e.g., the resilient members 150 shown in FIG. 1) may be next attached to the frame, e.g., the frame 811. The edge pad, e.g., the edge pad 807 may be next placed on top of the frame 811 and the resilient members. The safety poles 820*a*-820*f* may be next attached to the frame 811, and the safety net 809 may be next attached.

Further modifications of the invention within the scope of the appended claims are feasible. As such, the present invention should not be considered as limited by the embodiments and figures described herein. Rather, the full scope of the invention should be determined by the appended claims, with reference to the description and drawings.

Various embodiments of the invention have been described in detail with reference to the accompanying drawings. References made to particular examples and implementations are for illustrative purposes and are not intended to limit the scope of the invention or the claims.

It should be apparent to those skilled in the art that many more modifications of the trampoline besides those already described are possible without departing from the inventive concepts herein. The inventive subject matter, therefore, is not to be restricted except by the scope of the appended claims. Moreover, in interpreting both the specification and the claims, all terms should be interpreted in the broadest possible manner consistent with the context.

Headings and sub-headings provided herein have been provided as an assistance to the reader and are not meant to limit the scope of the invention disclosed herein. Headings and sub-headings are not intended to be the sole or exclusive location for the discussion of a particular topic.

While specific embodiments of the invention have been illustrated and described, it will be clear that the invention is not limited to these embodiments only. Embodiments of the invention discussed herein may have generally implied the use of materials from certain named equipment manufacturers; however, the invention may be adapted for use with equipment from other sources and manufacturers. Equipment used in conjunction with the invention may be configured to operate according to conventional methods and protocols and/or may be configured to operate according to specialized protocols. Numerous modifications, changes, variations, substitutions and equivalents will be apparent to those skilled in the art without departing from the spirit and scope of the invention as described in the claims. In general, in the following claims, the terms used should not be construed to limit the invention to the specific embodiments disclosed in the specification but should be construed to include all systems and methods that operate under the claims set forth hereinbelow. Thus, it is intended that the invention covers the modifications and variations of this invention provided they come within the scope of the appended claims and their equivalents.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

We claim:

1. A trampoline, comprising:

a frame;

a flexible mat;

a plurality of resilient members attached to the frame and to the flexible mat, wherein the resilient members receive kinetic energy from a user jumping on the flexible mat, causing the user to rise above a surface of the flexible mat;

a plurality of safety poles attached to the frame and residing substantially above the surface of the flexible mat; and a safety net removably attached at a top portion of each safety pole of the plurality of safety poles, the safety net having an upper high tension line attached at an upper end of the safety net and a lower high tension line removably attached to a mid-section of each safety pole of the plurality of safety poles, wherein a region of the safety net between the upper high tension line and the lower high tension line resides at a higher tension than other regions of the safety net.

2. The trampoline of claim 1 wherein the region of the safety net between the upper high-tension line and the lower high-tension line withstands forces in a vertical range of 20-30 N and in a horizontal range of 40-50 N.

3. The trampoline of claim 1 wherein the safety net is removably attached to the top portion of each safety pole of the plurality of safety poles by a tether of a plurality of tethers attached to the safety net.

4. The trampoline of claim 3 wherein the top portion of each safety pole of the plurality of safety poles comprises a removable top cap, wherein the removable top cap includes a hook configured for attachment to a loop on an end portion of the tether of the plurality of tethers.

5. The trampoline of claim 3 wherein the top portion of each safety pole of the plurality of safety poles further comprises a removable top cap, wherein the removable top cap includes an internal cylinder configured to retain a loop on an end of the tether of the plurality of tethers.

6. The trampoline of claim 1 wherein the lower high-tension line is removably attached to each safety pole of the plurality of safety poles by a plurality of tethers.

7. The trampoline of claim 1, further comprising:

an edge pad resting on an upper surface of the frame and extending to the flexible mat, wherein the edge pad includes a material to absorb shock from the user falling on the edge pad; and a connector attached at a lower end of the safety net below the lower high-tension line, wherein the connector may be removably attached to the edge pad.

8. The trampoline of claim 7 wherein the connector is removably attached by one of a zipper, buttons, a belt, string, rope, snaps, and hook and loop fasteners.

9. The trampoline of claim 1 wherein each pole of the plurality of safety poles leans outward from the frame by a predetermined degree.

10. The trampoline of claim 9 wherein the predetermined degree resides in a range from greater than 1 degree to greater than or equal to 20 degrees.

11. The trampoline of claim 10 wherein the predetermine degree resides in a range from greater than or equal to 6 degrees to greater than or equal to 10 degrees.

12. The trampoline of claim 1 wherein the frame is substantially shaped as one of a rectangle, square, circle, oval, and stadium.

* * * * *